US005226707A

United States Patent [19]

Han et al.

[11] Patent Number: 5,226,707

[45] Date of Patent: Jul. 13, 1993

[54] FOODSTUFF CONTAINER RECEIVING APPARATUS

[75] Inventors: Man Y. Han, Seoul; Mong S. Kang, Kyungki, both of Rep. of Korea

[73] Assignee: Samsung Electronics Co., Ltd., Suweon, Rep. of Korea

[21] Appl. No.: 826,879

[22] Filed: Jan. 28, 1992

[30] Foreign Application Priority Data

Jan. 29, 1991 [KR] Rep. of Korea ..... 91-1287[U]

[51] Int. Cl.[5] ..... A47B 88/00

[52] U.S. Cl. ..... 312/408; 312/246; 312/298; 312/334.24

[58] Field of Search ..... 312/408, 404, 246, 298, 312/311, 334.7, 334.8, 334.14, 334.27, 334.28, 334.32, 334.34, 334.35; 248/318, 317, 309.1; 220/23.4, 23.83; 62/DIG. 11

[56] References Cited

U.S. PATENT DOCUMENTS

| | | | |
|---|---|---|---|
| 405,166 | 6/1889 | Katherman | 312/334.27 |
| 1,527,282 | 2/1925 | Steadman | 312/246 |
| 2,042,993 | 6/1936 | Hopes | 62/DIG. 11 |
| 2,103,885 | 12/1937 | Whalen | 312/246 |
| 2,215,665 | 9/1940 | Hedlund | 312/246 |
| 3,353,886 | 11/1967 | Tompkins | 312/311 |
| 4,653,818 | 3/1987 | De Bruyn | 312/246 |
| 4,735,470 | 4/1988 | Falk . | |
| 4,927,108 | 5/1990 | Blazic | 312/246 |
| 4,944,566 | 7/1990 | Carper | 312/246 |

*Primary Examiner*—Peter M. Cumomo
*Assistant Examiner*—Flemming Saether
*Attorney, Agent, or Firm*—Burns, Doane, Swecker & Mathis

[57] ABSTRACT

A food storage apparatus comprises a frame defining a forwardly open space adapted to receive a plurality of food storage containers. The frame, which can be slidably mounted on a support within a refrigerator, includes inwardly projecting flanges adjacent its upper portion, and two pairs of front-to-rear extending bars located adjacent a lower portion of the frame. The bars of each pair are parallel and spaced horizontally apart. Each container includes outward flanges slidably disposed on the shoulders, and a boss projecting downwardly from an underside of the container and situated between a pair of the bars.

3 Claims, 3 Drawing Sheets

FOODSTUFF CONTAINER RECEIVING APPARATUS

BACKGROUND OF THE INVENTION

This invention relates to storing foodstuff in any chamber of a refrigerator, and particularly to a foodstuff container receiving apparatus for storing small quantities of various types of foodstuff in selected individual containers.

Today's household refrigerators are generally provided with a freezing chamber and a refrigerating chamber arranged in a vertical superimposed configuration, each of which permits the storage of freezing foods and refrigerating foods. Especially, the refrigerating foodstuff is going to be diversified, so it is necessary to classify foodstuffs to be stored into their types, and it is preferable for the user to provide direct-access to the corresponding food stored in a selected container when desired.

Also, in consideration that microwave ovens are broadly used in general households. If previous cooked foods stored in a refrigerator is simply reheated again at morning or at a desired time, it can lead to a convenient life pattern. It is known that the storage of a food storage container exclusively adapted to the electronic range is very advantageous.

Typical prior art is disclosed in U.S. Pat. No. 4,735,470 entitled "REFRIGERATOR INCLUDING A SECONDARY FOOD STORAGE ARRANGEMENT", in which a refrigerator food storage compartment having a shelf assembly includes a pair of vertically extending laterally spaced rail members. A shelf is supported on a pair of horizontally extending arm members which are positioned on the rail members. Carried on the shelf assembly is a secondary food storage arrangement supporting a plurality of containers. The arm members include confronting grooves arranged below the shelf, and slidably arranged in the grooves is a container supporting frame which includes pairs of confronting flanges supporting the frame to provide access to the containers. The front portion of the frame includes a front opening through which the containers may be removed while the container supporting frame remains attached below the shelf.

In particular the secondary food storage assembly is provided with the frame and a plurality of the containers. The frame includes front and rear walls, two side walls and a divider member fixed midway between the side walls to form two side-by-side support regions. Each of the side walls has a flange projected from its lower edge into the support regions, and also the divider member has flanges extended from its lower edge into the support regions. The container is provided with a projection integrally extended outward from around its side walls to enable the plurality of containers to be supported on the support frames.

But, this arrangement has a shortcoming in that when a selected container is to be removed from the support frame, the support frame is pulled out, and then the selected container must be removed in reverse-order of placing the containers on the supporting frame. That is, a container located farthest from the user cannot be removed until a container located closest to the user is removed. The containers may often fall off due to careless mistakes when placing them on the support frame, i.e., when the projection of the container is not properly suspended on the flanges of both side walls and the divider member. Furthermore, the frame cannot be adapted to a conventional self rail member due to the formation of a particular shaped flange projecting outward from the side walls thereof.

Accordingly, the object of the present invention is to provide a foodstuff container receiving apparatus exclusively adapted to use in conjunction with a microwave oven.

Another object of the present invention is to provide a foodstuff container receiving apparatus making it possible to remove a plurality of containers from a frame, individually, and in any order as well as to enable the frame to be easily positioned on a shelf assembly.

Also, another object of the present invention is to provide a foodstuff container receiving apparatus whose use is simple and convenient.

SUMMARY OF A PREFERRED EMBODIMENT OF THE INVENTION

The present invention concerns a foodstuff container receiving apparatus comprising a frame and a food storage container, in which the frame is made into a box form and includes a front portion with a handle forming at least one opening for placing/removing a food storage container therethrough, a rear wall and spaced parallel side walls having a flange extended outward from each of the upper portion thereof and a shoulder formed inward form each of the upper portion thereof, at least one intermediate wall dividing the frame into at least one portion between both side walls and having shoulders formed on the upper portion thereof, at least one transverse bar and a pair of lengthwise bars mounted in a spaced parallel relation between any one of two side walls and the intermediate wall to form the bottom surface of the frame, and a food storage container includes a flange extended from the upper portion to be supported by the shoulders of the intermediate wall and each of both side walls and a boss projected from the bottom surface to be inserted between the supporting bars.

As described above, the present invention is adaptable to any refrigerator due to its simple configuration and facilitates a selected container to be removed from a frame independent of the order in which the containers were inserted.

BRIEF DESCRIPTION OF THE ATTACHED DRAWINGS

The present invention will be described in detail below to the accompanying drawings, in which.

DETAILED DESCRIPTION OF A PREFERRED EMBODIMENT OF THE INVENTION

Figure 1:
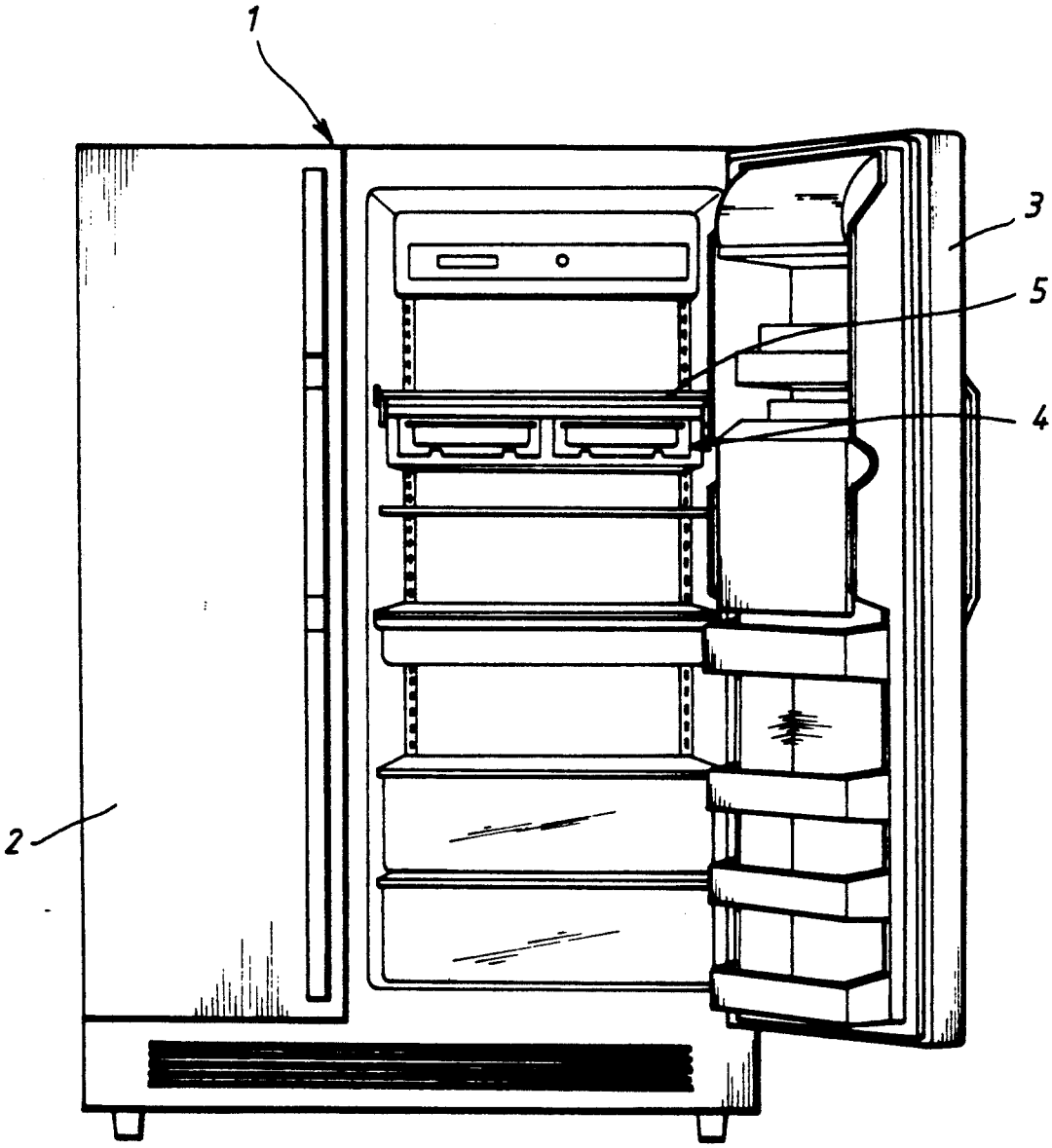
FIG. 1 is a front view of a combination refrigerator having a refrigerating chamber opened to show the installment of a foodstuff container receiving apparatus according to the present invention.
Figure 2:
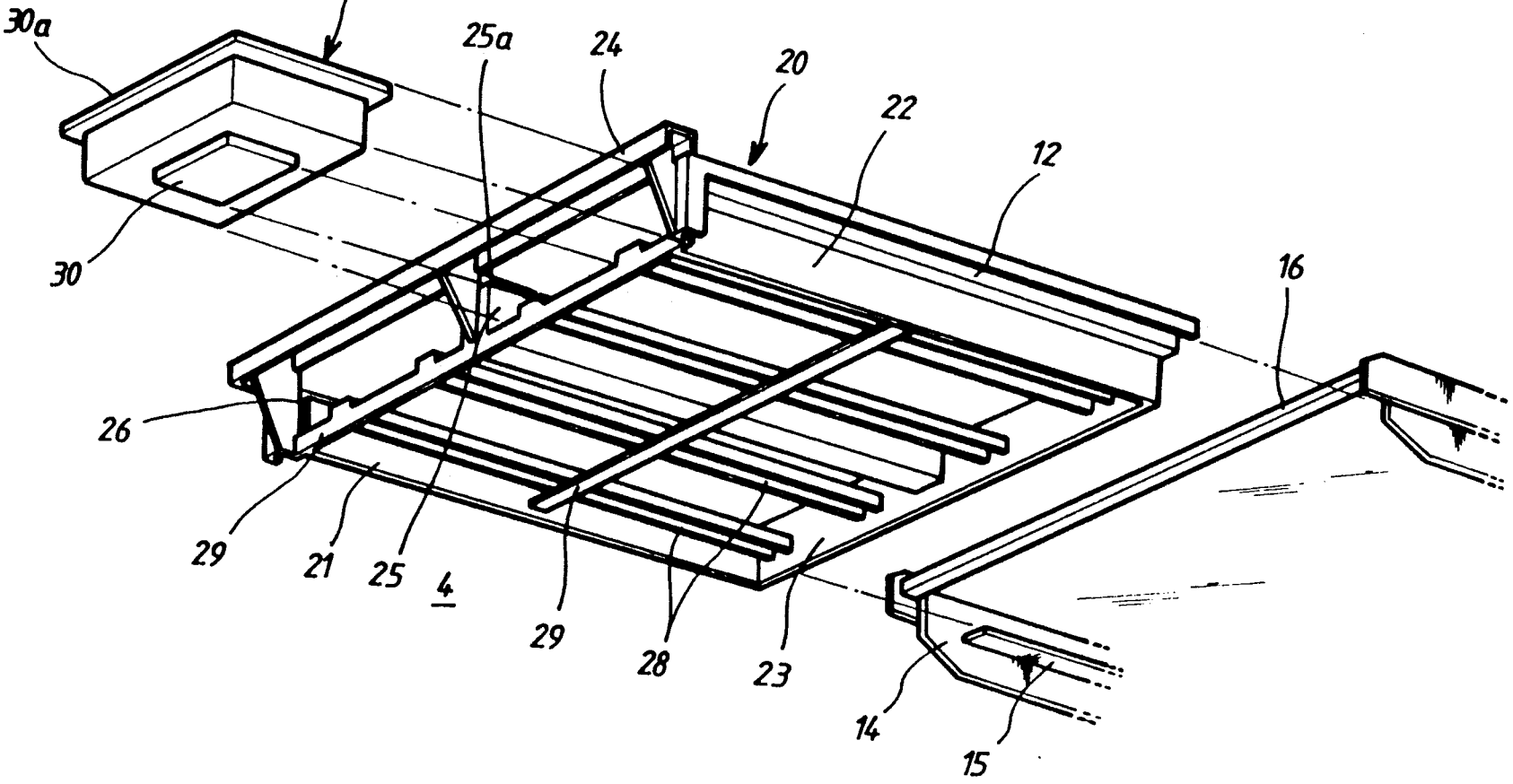
FIG. 2 is an exploded perspective view of showing a frame and one container separated from each other considered as parts of a foodstuff container receiving apparatus according to the present invention; and, FIG. 3 is a vertical cross-sectional view of a foodstuff container receiving apparatus showing the positioning of a plurality of containers on a frame according to the present invention.
Figure 3:
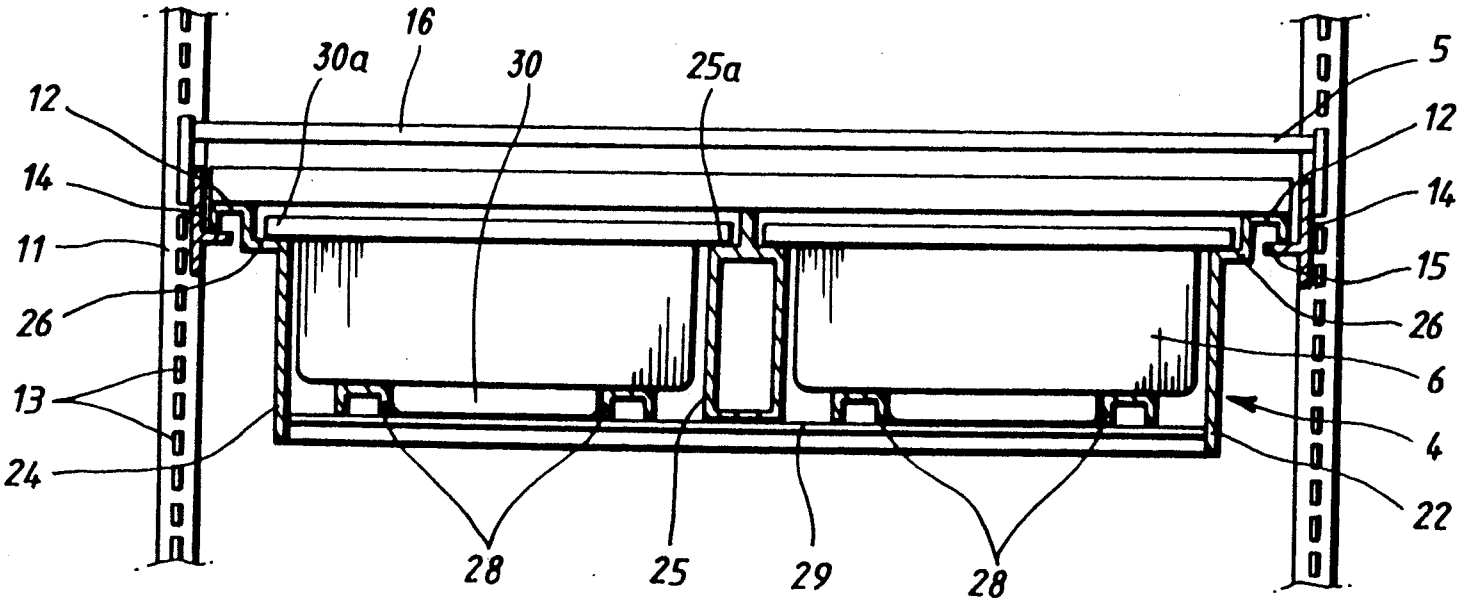

Referring to the drawings, a refrigerator 1 includes a freezing chamber and a refrigerating chamber, each of which functions to store freezing foods and refrigerating foods. The chambers are closed by a freezing chamber door 2 and a refrigerating chamber door 3.

A foodstuff container receiving apparatus 4 of the present invention is slidably mounted on a shelf assembly 5 which is arranged in the refrigerating chamber. The shelf assembly 5 is supported on the rear wall of a chamber in accordance with conventional practices. In other words, the shelf assembly 5 is provided with a pair of vertically extending elongated, laterally spaced, parallel mounting members 11 and a pair of horizontally extending, laterally spaced brackets 14 each having a hook member (not shown). The mounting member 11 which has a plurality of vertically spaced receiving slots 13 is secured to the rear wall of a refrigerating chamber. The paired brackets 14 include confronting projections 15 extended from their inner walls. Support bars 16 are fixed to the front and rear of the paired brackets 15. Therefore, the paired brackets 15 are supported, in cantilever fashion, by inserting their hook members into the corresponding slots 13 on the rear wall of a chamber. Whereby the paired brackets 15 can support a foodstuff container receiving apparatus 4 according to the present invention.

The foodstuff container receiving apparatus 4 comprises a plurality of food storage containers 6 and a frame 20. The frame 20 is in the form of a box having a greater height than the container 6. Also, the frame 20 includes spaced parallel side walls 21 and 22, a rear wall 23, a front portion having an opening for removing the food storage containers 6 therefrom and a handle portion 24 fixed thereto to maintain the frame shape as well as to enable the frame 20 to be pushed into or pulled out from the paired brackets 15. The side walls 21 and 22 include flanges 12, which are extended outward from the upper portion to slidably mount the frame 20 on the projections 15 of the brackets 14. Inner surfaces of the side walls 21, 22 are provided along their upper edges with shoulders 26 which support the containers 6 thereon. The frame 20 also may have an intermediate wall 25 dividing it into two support regions according to the predetermined size of the food storage container 6 to be positioned between the side walls 21 and 22. The intermediate wall 25 may be mounted between both side walls 21 and 22, and is provided with two shoulders **25*a* formed on both sides of its upper portion, which oppose the shoulders 26. On the lower portion of the frame 20 there are mounted a plurality of paired lengthwise bars 28. The bars of each pair are parallel and spaced apart between the intermediate wall 25 and a respective one of the side walls 21 and 22. Transverse bars 29 are fixed on the front portion and the middle portion of the frame 20. These bars 28, 29 form the bottom surface of a box defined by the frame 20. The paired lengthwise bars 28 slidably support the food storage containers 6 thereon, and the size of the gap formed therebetween depends upon the size of the food storage container 6** to be carried.

The food storage container 6 is provided with a flange **30*a* projected outward from around the upper portion thereof, so that it may be safely seated upon the shoulders 26 and 25*a* of a respective on of the side walls 21, 22 and the intermediate wall 25. Formed on the bottom surface of the food storage container 6 is a boss 30 which is integrally projected therefrom. The boss 30 is inserted between the paired lengthwise bars 28, when the food storage container 6 is placed on the frame 20. Herein the shape of the food storage container 6 is preferably rectangular. The food storage containers 6** in the present invention are microwaveable, dishwasher safe and are sealed by a cover (not shown).

Thus, the present invention enables a plurality of food storage containers to be placed in a predetermined order through the front portion on the frame, or only the selected container can be placed on and/or removed from the frame independent of its arrangement order.

What is claimed is:

1. A food storage apparatus disposable within a refrigerating compartment, comprising:

a frame adapted to be slidably mounted within said refrigerating compartment and forming a container-receiving space, a front end of said space being open, said frame including:

horizontally outwardly projecting shoulders extending in a front-to-rear direction for slidably mounting said frame on a support, horizontally inwardly projecting shoulders extending in a front-to-rear direction adjacent an upper portion of said frame, and a pair of horizontally spaced parallel bars extending horizontally in a front-to-rear direction adjacent a lower portion of said frame, at least one food storage container insertable into said space through said open front end thereof, said container including:

flanges extending horizontally outwardly adjacent an upper portion of said container and slidably disposed on said inwardly projecting shoulders, and a boss projecting downwardly from an underside of said container and disposed between said bars such that portions of said container situated outwardly of said boss overlie said bars.

2. A food storage apparatus according to claim 1, wherein said frame includes two side walls extending in front-to-rear directions, and an intermediate wall disposed between said side walls and extending in a front-to-rear direction, said intermediate wall dividing said space into two side-by-side portions, each space portion having a pair of said inwardly projecting shoulders, one of said shoulders of each pair being disposed on said intermediate wall, and the other being disposed on a respective side wall, there being a pair of said bars in each space portion, there being a plurality of said containers.

3. A food storage apparatus according to claim 1, wherein said frame includes side walls and front and rear walls, and at least one transverse bar extending from one side wall to the other beneath said front-to-rear extending bars.

* * * * *